United States Patent [19]

Dufau et al.

[11] Patent Number: 4,656,676

[45] Date of Patent: Apr. 14, 1987

[54] PRESSURE ACTIVATED CLEANER DISCHARGE FOR TOILETS AND THE LIKE

[75] Inventors: Oscar R. Dufau, Fullerton; Kabir Siddiqui, Brea, both of Calif.

[73] Assignee: Fluidmaster, Inc., Anaheim, Calif.

[21] Appl. No.: 846,071

[22] Filed: Mar. 31, 1986

[51] Int. Cl.[4] ..... E03D 9/02

[52] U.S. Cl. ..... 4/228; 137/205.5

[58] Field of Search ..... 4/228, 224, 223, 225, 4/227, 226, 230, 363; 137/564.5, 205.5, 101.11; 210/97, 198.1, 169; 222/57, 61, 62

[56] References Cited

U.S. PATENT DOCUMENTS

| | | | |
|---|---|---|---|
| 618,349 | 1/1899 | Heany | 4/225 |
| 1,205,513 | 11/1916 | Carlson | 4/225 |
| 2,479,842 | 8/1949 | Kirwan . | |
| 2,989,185 | 6/1961 | Lombardi | 210/169 |
| 2,993,214 | 7/1961 | Franco . | |
| 3,118,462 | 1/1964 | Pannutti | 4/224 |
| 3,304,564 | 2/1967 | Green et al. | 137/205.5 |
| 3,327,325 | 6/1967 | Roger | 4/227 |
| 3,556,141 | 1/1971 | Hind | 137/564.5 |
| 3,974,847 | 8/1976 | Hodges | 137/101.11 |
| 4,183,108 | 1/1980 | Hamilton | 4/363 |
| 4,319,369 | 3/1982 | Lippincott, Sr. . | |
| 4,429,423 | 2/1984 | Syrenne | 4/225 |

FOREIGN PATENT DOCUMENTS

| | | | |
|---|---|---|---|
| 624260 | 7/1961 | Canada | 137/205.5 |
| 83/00713 | 3/1983 | World Int. Prop. O. | 4/223 |
| 211271 | 2/1924 | United Kingdom | 4/226 |

*Primary Examiner*—Stephen Marcus
*Assistant Examiner*—Leo James Peters
*Attorney, Agent, or Firm*—George E. Schick

[57] ABSTRACT

The pressure activated cleaner discharge device is used in a standard toilet water tank, the tank having a ballcock for discharging water to fill the tank from a minimum water level to a maximum water level. The tank also includes a flush valve connected to a toilet bowl for flushing water therein from the tank, and an overflow pipe projecting above the maximum water level having a ballcock refill tube connected thereto for directing a pressure flow of tank water to refill the toilet bowl after said flushing. The cleaner discharge device includes a container in the tank having an inlet and outlet, an inlet water tube connected between the refill tube and the container inlet, and an outlet cleaner tube connected between the container outlet and the refill tube downstream of the inlet water tube connection. The refill tube and its connections and the container and its connections are all liquid-tight from the ballcock to the refill pipe substantially throughout the downstream flow of water therein. Furthermore, the connection between the outlet cleaner tube and the refill tube may have means for increasing the drawing of the liquid cleaner from the container and these additional devices may be a venturi, a right angle projecting tube with either downstream holes or a downstream angled end, or an angled tube angling downstream, any one or all.

10 Claims, 10 Drawing Figures

PRESSURE ACTIVATED CLEANER DISCHARGE FOR TOILETS AND THE LIKE

BACKGROUND OF THE INVENTION

This invention relates to a pressure activated cleaner discharge device for toilets and the like, and more particularly, to such a device for adding a determined measured amount of liquid cleaner or other materials to each quantity of water during each toilet flush. The added quantity of liquid cleaner or other material is adaptable for cleaning or disinfecting or otherwise treating the particular water during and after flush, all in an efficient manner. Furthermore, the pressure activated cleaner discharge device has the distinct advantage of mixing the particular materials with the toilet bowl water directly within the toilet bowl and on an automatic basis, rather than requiring, as has been true in many prior applications, the mixture of a large and cumbersome amount of cleaner additive or other material to the entire toilet water tank.

Various types and sizes of chemical packages and chemical holding containers dealing with both solid and liquid forms thereof have heretofore been provided over the period of years. Furthermore, these prior chemicals have dealt primarily with the adding of the same to the relatively large toilet water tanks. These have not been totally satisfactory for many reasons, not the least of which is the having to deal with the relatively large toilet water tank when the chemicals are really required within the toilet bowl.

As an example, the cleaning chemicals have been provided in a water soluble, solid form. The solid form of chemical is suspended beneath the normal water level within the toilet water tank and the degree of solubility of the chemical is depended upon to dissolve the same and circulate it throughout the relatively large toilet water tank. Thus, when there is a water flush, the dissolved chemical is carried with the normal flushing water directly into the toilet bowl. In addition, since the chemical is circulated within the entire flushing water, a very large portion thereof is flushed directly through the toilet bowl and this is true of any chemical, a cleaner or otherwise, which is dissolved in the toilet water tank.

Another form of chemical emitting device which has previously been used makes use of a plastic container which holds an amount of chemical therein and has particular size openings to permit a certain amount of the chemical to be released from the plastic container during every circulation of water. The particular plastic container is fabricated for being positioned resting on the bottom wall of the toilet water tank, or suspended at an intermediate location on one of the side walls of the toilet water tank. More important, since these devices discharge a given quantity of the chemical every time the liquid in the toilet water tank is circulated, this means that the given quantity of chemical will be discharged during each flush as determined by this water movement. Various different forms of valves have been provided for the plastic container in order to assure the proper release of the chemical, but at best, these cannot be very accurate and, again, we are still dealing here with the relatively large quantity of water in the toilet water tank which must ultimately circulate into the toilet bowl rather than placing the chemical additive solely within the bowl where it is primarily needed.

In an effort to overcome this deficiency, various complicated valves and other mechanical mechanisms have been provided in combination with particular forms of devices which add the chemical additive for cleaning, disinfecting and deodorizing directly into the toilet bowl or directly into the charge of water for refilling the toilet bowl. This, of course, eliminates the objection to the relatively large toilet water tank and the attempt to add chemicals therein with only a portion having the opportunity to act against the contaminants within the toilet bowl. Probably the most severe fault of these various forms of prior valves and other mechanisms has been the complicated nature thereof and the expense required for providing the same. Furthermore, even where provided, these prior devices are not truly properly adjustable and require the constant care of a trained technician.

OBJECTS AND SUMMARY OF THE INVENTION

It is, therefore, an object of this invention to provide a pressure activated cleaner discharge device for toilets and the like which is of a maximum simplicity, yet it is of a maximum positive use and without the requirement for tedious regulation. With the use of the cleaner discharge device of the present invention, an addition to the standard equipment within the toilet water tank which normally includes the ballcock, the flush valve, the overflow pipe, and the ballcock refill tube directed into the overflow pipe, the present invention only requires a particular form of liquid-tight, preferably plastic container which has an inlet water tube connected between the container and the refill tube and an outlet cleaner tube connected between the container and the refill tube downstream of the inlet water tube connection. Otherwise, the refill tube and the container with its connecting tubes is liquid-tight during the downward flow of flushing water and the liquid cleaner during a toilet flush. Furthermore, the pressure activated cleaner discharge device, once assembled in the toilet tank, operates completely automatically, with the exception of requiring replenishment of the liquid cleaner in the container when it becomes exhausted. The cleaner discharge device operates totally automatically everytime the toilet is flushed and serves to add the desired liquid cleaner and other chemical treatment, if desired, directly into the toilet bowl for functioning exactly as contemplated.

It is a further object of this invention to provide a pressure activated cleaner discharge device for toilets and the like which satisfies the foregoing object, yet if desired for even more surely guaranteeing the proper operability, may make use of relatively standard equipment in a quite novel combination including a low pressure creating liquid flow means or device. This additional low pressure creating device may be a venturi, other low pressure creating devices, or the combination of a venturi with other low pressure creating devices, any one or all which may be installed at the outlet of the usual refill tube as the refill tube is directing toilet bowl refill water into the usual overflow pipe. Whatever added low pressure creating liquid flow means is used, the device is arranged so that the cleaner liquid in addition to the internal device pressure is provided with the low pressure for adding to the the movement of the liquid cleaner from the container. Thus, again, the liquid cleaner is not only moved by pressure against the same tending to urge it from the container to the refill tube, but in addition, is additionally drawn from the container as caused by the particular low pressure creating liquid flow means or devices otherwise used, all on a completely automatic basis.

It is still an additional object of this invention to provide a pressure activated cleaner discharge device for toilets and the like which satisfies either or both of the foregoing objects in a simple and efficient manner, yet the added cleaner discharge device may be fabricated in a quite simple and economical manner, despite the operating dependability of the same. All of the tubes added for the proper liquid communication, in the container are of known materials as used in the plumbing trade. For instance, the various tubes connecting the container to the refill tube are merely of the same materials and of lesser size with the container primarily being a standard, screw top container of liquid-tight nature. Where used, the only portion of the device which requires some slight skill at molding is the low pressure creating liquid flow means or devices which are added for insurance at operability and these can be formed separately in an added casing which attaches to the end portion of the refill tube. Still in addition, if the cleaner discharge device requires additional anti-syphon protection in addition to that normally provided at the ballcock, this too can be formed of maximum simplicity with assured reliability.

Other objects and advantages of the invention will be apparent from the following specification and the accompanying drawings which are for the purpose of illustration only.

DESCRIPTION OF THE BEST EMBODIMENTS CONTEMPLATED

The principles of the present invention deal with a pressure activated cleaner discharge device and various embodiments thereof, which may be used in combination with a standard form of toilet or the like. The basic purpose of such a cleaner discharge device is the selected addition of chemicals and other materials to the toilet flushing water for added cleaning, disinfecting, deodorizing or any other intended purposes, any one or all. Thus, in the following specification and claims, when "cleaner" or "cleaning" is used, it is intended to refer to the various singular or plural additives that might be used, a cleaner merely being an example. Furthermore, the various standard elements of the toilet flushing mechanism are given as an example and to which the pressure activated cleaner discharge device may be added, and it is not intended to limit the principles of the present invention to the particular equipment shown.

Figure 1:
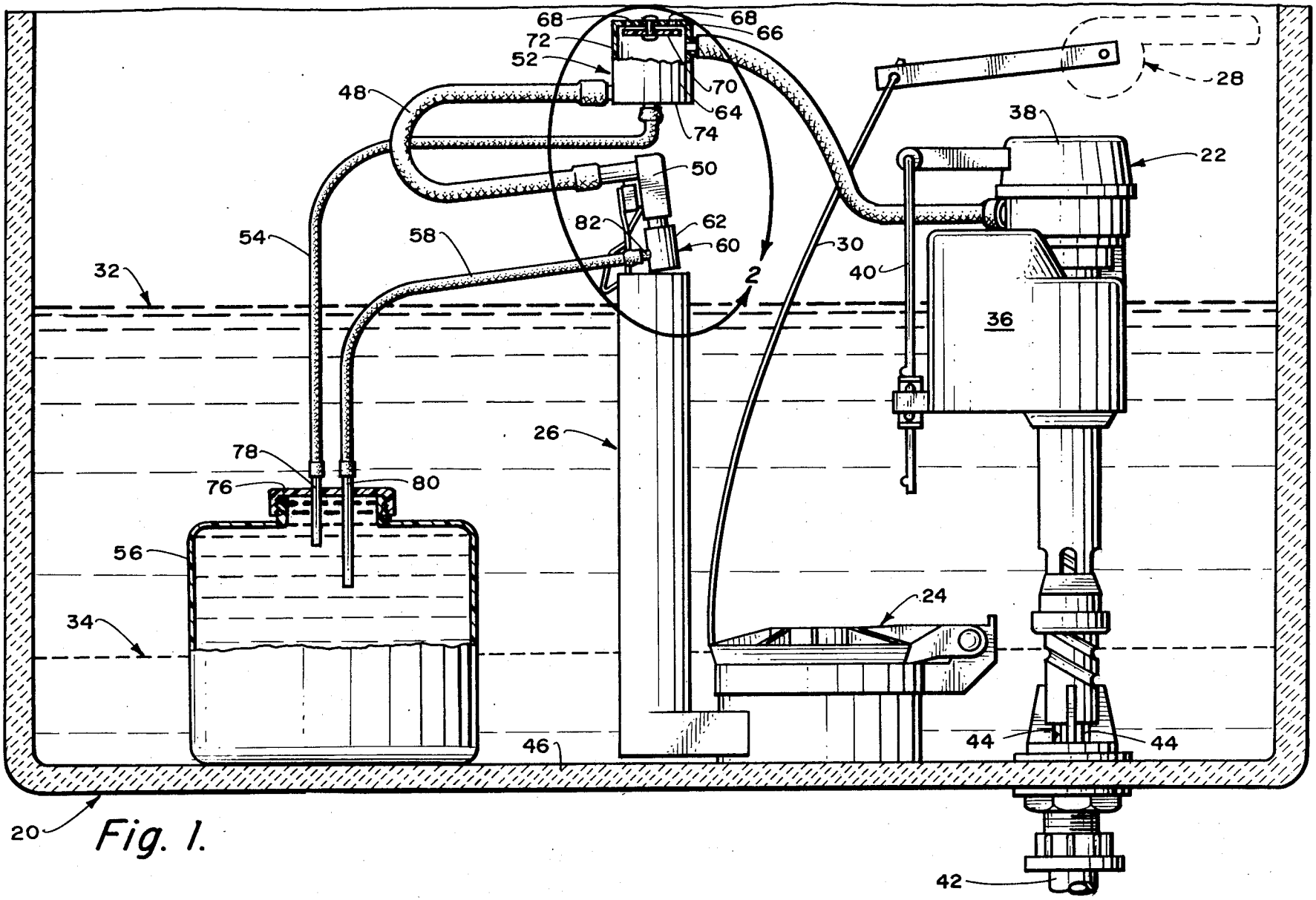
FIG. 1 is a side elevational view of a toilet water tank with the assembly of a ballcock, a flush valve and an overflow pipe arranged therein, and added thereto the assembly of a preferred embodiment of the pressure activated cleaner discharge device of the present invention, the toilet water tank being shown in vertical section.

Referring initially to FIG. 1, the standard water flushing equipment of the particular toilet includes an upwardly opening toilet water tank generally indicated at 20 which serves to mount a ballcock generally indicated at 22, a flush valve generally indicated at 24 and an overflow pipe generally indicated at 26. The flush valve 24 is opened by pivoting a valve actuator 28 applying tension to the strap 30 with the valve remaining open, normally by trapping air, until the flushing water drains downwardly from a maximum water level 32 to a minimum water level 34, the latter being approximately at the flush valve 24. During the flushing water drainage, the downward movement of the flushing water level lowers a ballcock float 36 which pivots a ballcock valve 38 through levers 40 to open the ballcock 22 into a main water supply line 42 and cause a main water supply to pass upwardly within the ballcock centrally thereof through the ballcock valve 38 and downwardly at an outer portion of the ballcock 22, finally exiting into the toilet water tank 20 at ballcock flow inlets 44 very near a tank bottom wall 46.

The flushing water in the toilet water tank 20 drains downwardly through the flush valve 24 and through the toilet bowl (not shown) until the flush valve closes, the flushing water in the tank 20 having reached the minimum water level 34. At this point, with the ballcock valve 38 remaining open, the flushing water builds upwardly toward the maximum water level 32 ultimately moving the ballcock float 36 upwardly to close the ballcock valve 38 and cause a cessation of the water flow from the main water supply line 42. During the entire time that the main flushing water is directed through the ballcock 22 to aid in the final flushing and ultimately refill the toilet water tank 20 to its maximum water level 32, a small portion of such flushing water is directed by the ballcock valve 38 into a ballcock refill tube. In the ballcock refill tube 48, this smaller portion passes through the refill tube nozzle 50 into the upper end of the overflow pipe 26 ultimately flowing downwardly therein and around the flush valve 24, the flush valve having no control thereon, and ultimately into the toilet bowl (not shown) for refilling the same with a particular amount of water.

Still referring to FIG. 1, the standard water flushing equipment of the particular toilet is shown in combination with a first preferred embodiment of the pressure activated cleaner discharge device forming the principles of the present invention. As shown, an anti-syphon device 52 is connected to the ballcock refill tube 48 intermediate the same, this being installed herein in addition to the normal anti-syphon device directly within the ballcock 22 for the assurance of absolute anti-syphon safety as will be hereinafter discussed. In addition, the cleaner discharge device includes an inlet water tube 54, a container 56, an outlet cleaner tube 58 and, preferrably, a low pressure creating device generally indicated at 60. In this particular assembly, the inlet water tube 54 is connected between the anti-syphon device 52 and the container 56, the outlet cleaner tube 58 is connected between the container 56 and the low pressure creating device 60, and the low pressure creating device 60 is mounted in a casing 62 secured to the end of the refill tube nozzle 50.

More particularly, as shown in FIGS. 1, 2, 3 and 4, the anti-syphon device 52 includes a hollow, cylindrical body 64 having a top wall 66 which is provided with at least two air openings 68 which have underlying an upward and downward movable closure 70. The ballcock refill tube 48 extending from the ballcock 22 is connected to a side wall 72 intermediate the right hand side as shown and the ballcock refill tube 48 exits the anti-syphon device 52 at the lower portion on the left hand side of the side wall 72. The inlet water tube 54 is of less cross sectional dimension than the ballcock refill tube 48 and is connected to the anti-syphon device 52 at a lower wall 74.

All of the anti-syphon device 52, the container 56 and the low pressure creating device 60 are formed of usual plastics so that molding may be used for fabrication. Also, the inlet water tube 54 and the outlet cleaner tube 58 are formed of usual hose materials similar to those used for the ballcock refill tube 48. Thus, the cost of fabricating these additional elements is relatively low.

Continuing with the cleaner discharge device in this first embodiment form, the container 56 may be formed with a screw top 76 having appropriate materials for liquid-tight sealing when the screw top is installed on the container 56. The inlet water tube 54 connects to the upper end of an inlet pipe 78, the pipe projecting downwardly through the screw top 76 and terminating a short distance within the container 56. A similar outlet pipe 80 is installed through the screw top 76 spaced slightly from the inlet pipe 78 and this outlet pipe 80 is of greater length than the inlet pipe 78 and has the outer end thereof connected to the outlet cleaner tube 58. The purpose of the different lengths of the inlet pipe 78 and the outlet pipe 80 is to prevent air from becoming trapped between the inlet ends of these pipes within the container 56 which could prevent liquid communication between the pipes.

Figure 4:
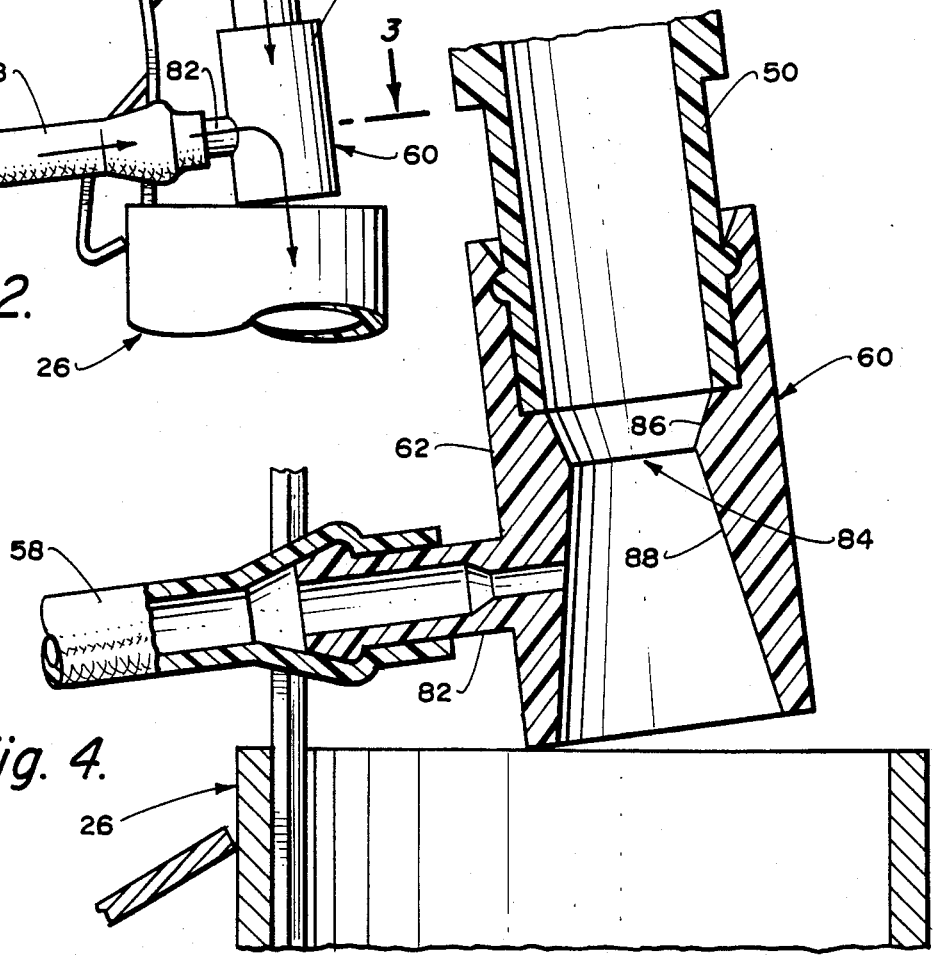
FIG. 4 is a still further enlarged, vertical sectional view looking in the direction of the arrows 4—4 in FIG. 3.

Finally, the other end of the outlet cleaner tube 58 spaced from the container 56 is connected to an inlet nipple 82 of the casing 62. As shown in FIG. 4, the casing 62 receives the lower end of the refill tube nozzle 50 therein secured by a pressure fit. Also, FIG. 2 outlines the liquid flow in the cleaner discharge device described and this will be discussed more completely below.

Figure 3:
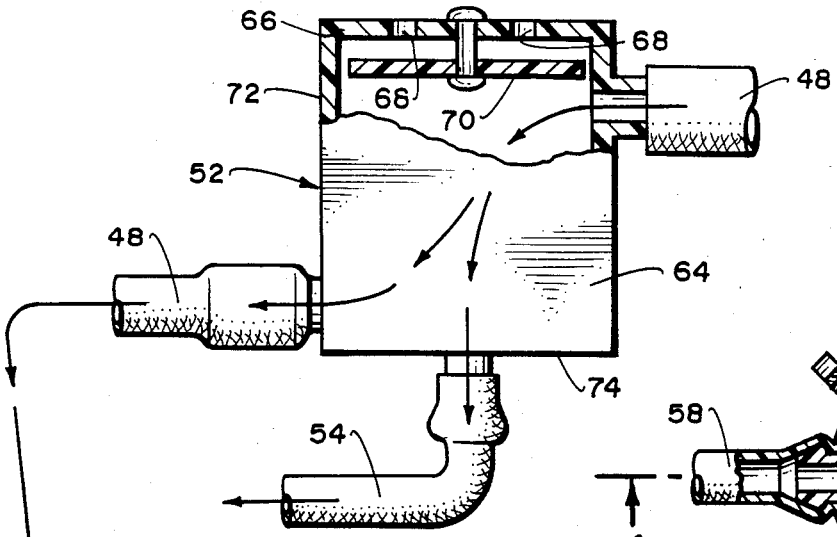
FIG. 3 is a horizontal sectional view looking in the direction of the arrows 3—3 in FIG. 2.
Figure 3:
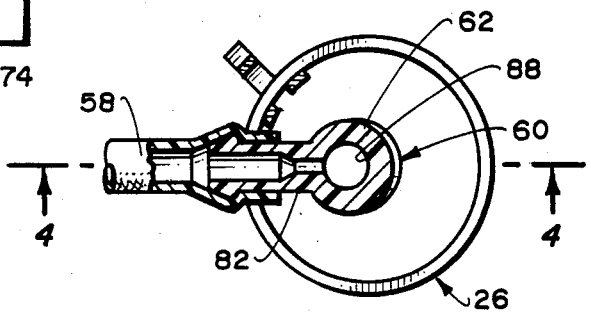
Figure 2:
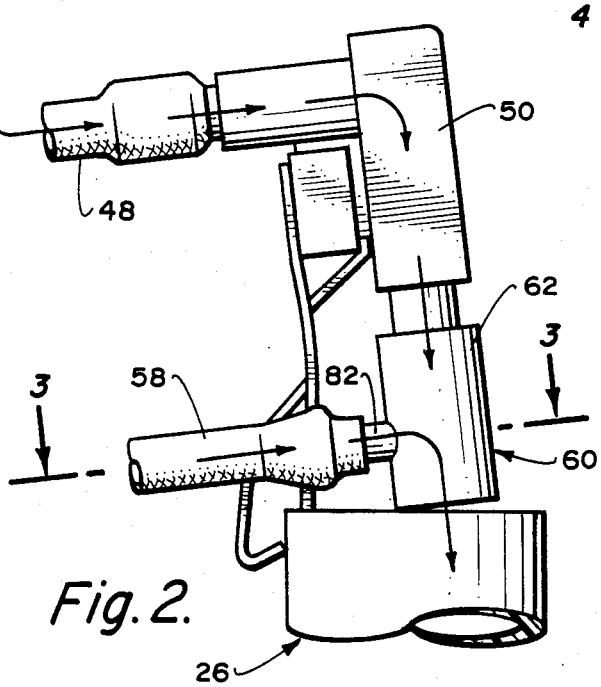
FIG. 2 is an enlarged, fragmentary side elevational view with certain parts broken away of an intermediate portion and an end portion of the refill tube with the end portion of the cleaner discharge device thereon, all mounted at the shown upper part of the overflow pipe.

Referring for the moment to FIGS. 2, 3 and 4, the casing 62 could have a straight, cylindrical opening therethrough and the cleaner discharge device would be operable since this is a pressure system as will be discussed below, however, the embodiment shown includes a venturi 84 within the casing 62. As best seen in FIG. 4, the venturi 84 is formed with a decreasing angled entrance portion 86 and an increasing angled exit portion 88, the inlet nipple 82 being connected appropriately at right angles with the increasing angled exit portion 88. Thus, a low pressure area is formed within the casing 62 for downward movement of liquid by both the increased pressure from the natural liquid flow and also from the venturi, that is, when the liquids are flowing downwardly within the refill tube nozzle 50 and also entering at right angles into the venturi 84. Thus, the combined liquids exit downwardly from the casing 62 into the overflow pipe 26 and ultimately into the toilet bowl, all of which will be discussed below.

In operation of this first embodiment of the pressure activated cleaner discharge device as applied to this toilet flushing system, with all of the elements being shown in FIG. 1 ready for the flushing action, the valve actuator 28 is pivoted drawing upwardly on the strap 30 to pivot the upper portion of the flush valve 24 and open the same. The flush valve 24 remains open due to trapping air or other flotation means permitting the flush water in the water tank 20 to begin to flow downwardly through the flush valve, thereby starting to decrease the water level in the tank from the maximum water level 32 shown. As the flushing water level in the water tank 20 begins to decrease, it permits the ballcock float 36 to move downwardly along the ballcock 22 opening the ballcock valve 38 through the levers 40 and admitting makeup water to enter the main water supply line 42, travel upwardly centrally of the ballcock and eventually downwardly along the outer portion of the ballcock, flowing into the water tank 20 through the ballcock float outlets 44.

At the same time, as the ballcock valve 38 opens, it also admits a portion of the inflowing makeup water to flow into the ballcock refill tube 48 and into the anti-syphon device 52. This incoming makeup water is under pressure and as a result, presses the closure 70 upwardly against the top wall 66 to liquid-tight seal the anti-syphon device 52 and force the makeup water to to continue to flow into the ballcock refill tube 48 at the left hand side of the anti-syphon device and into the inlet water tube 54. The water flowing into the ballcock refill tube 48 at the left hand side of the anti-syphon device 52 flows from its natural pressure downwardly into the refill tube nozzle 50 and ultimately through the casing 62, while the water flowing downwardly through the inlet water tube 54, also through its own natural pressure, flows into the container 56 mixing with the liquid cleaner therein. The mixed liquid cleaner water in the container 56 then flows into the outlet cleaner tube 58 and into the casing 62, and ultimately both paths of water mix and flow on downwardly into the overflow pipe 26. Thus, at this initial stage, both the flushing water passing downwardly through the flush valve 24 and the refill tube water with liquid cleaner mixed therein pass downwardly into the toilet bowl and on downwardly therein from the toilet system.

However, the flushing water quickly drains from the water tank 20 so that the water level in the tank reaches the lower minimum water level 34 and the flush valve 24 closes. The ballcock float 36 remains in its lower opening position due to the minimum water level so that the ballcock 22 now begins to once again fill the water tank 20. Furthermore, the water continues to flow in the ballcock refill tube 48 into the refill tube nozzle 50 and through the casing 62 continuing to mix with the liquid cleaner water received from the container 56 into the casing 62, the overall mixture passing on downwardly into the overflow pipe 26 and around the flush valve 24 into the toilet bowl to begin to refill the same. All of this continues until the water tank 20 is filled to the maximum water level 32 raising the ballcock float 36 and causing the ballcock valve 38 to close. This cuts off the incoming water from the main water supply line 42 and ends the flow through both the ballcock 22 through its main stream into the water tank and through the refill tube 48 for refilling the toilet bowl.

More particularly, concerning the water flow within the refill tube system, whether or not there is a venturi 84 within the casing 62, the natural pressure of the water will normally always cause water to flow downwardly within the inlet water tube 54, into the container 56, back out into the outlet cleaner tube 58 and into the casing 62 to mix with the refill water directly downwardly from the refill tube nozzle 50 for the provision of the liquid cleaner water passing into the overflow pipe 26 and downwardly into the toilet bowl. However, to guard against various contingencies such as, for instance, low water pressure, and to insure that the liquid cleaner will always be properly received by the toilet bowl, a venturi, such as the venturi 84 in the casing 62 may be added. This venturi 84 is fabricated in the usual manner for creating a low pressure area within the casing as caused by the flowing of the main refill water from the refill tube nozzle 50 downwardly through the venturi. This creation of the low pressure area causes the liquid cleaner water from the container 56 and the outlet cleaner tube 58 to not only enter through its own pressure, but also to be drawn in by the low pressure area from the venturi 84, the two positively causing the liquid cleaner water to mix with the main refill water within the casing 62 and all flow downwardly into the overflow pipe 26 ultimately to the toilet bowl (not shown). As a last possible safety factor for the cleaner discharge devices of the present invention, the anti-syphon device 52 guards against a complete breakdown of water pressure within the water system, the closure 70 of the anti-syphon device 52 due to extremely low water pressure may receive a reverse pressure from the ballcock refill tube 48 and the inlet water tube 54 which draws this closure 70 downwardly opening the two air openings 68 and preventing any possibility of the reverse flow back into the water system.

Figure 5:
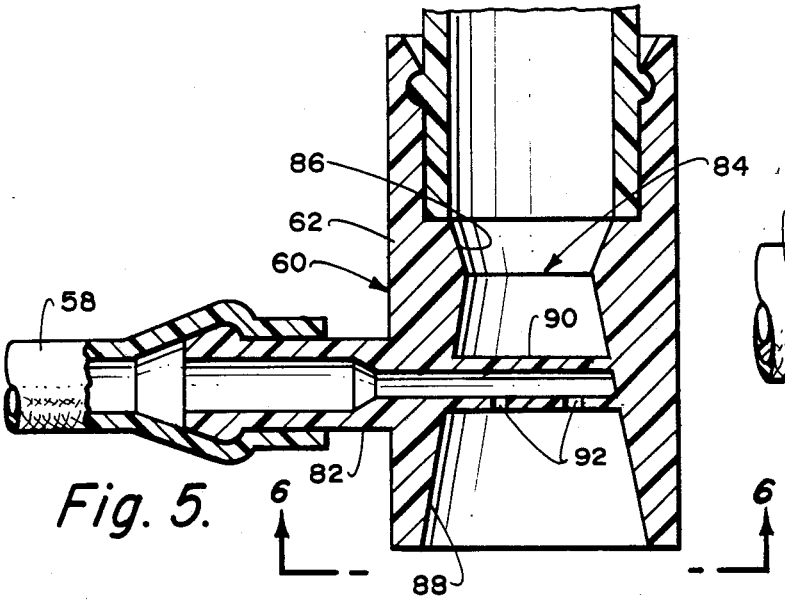
FIG. 5 is a view similar to FIG. 4 with the overflow pipe removed and showing a second embodiment of the cleaner discharge device of the present invention.
Figure 6:
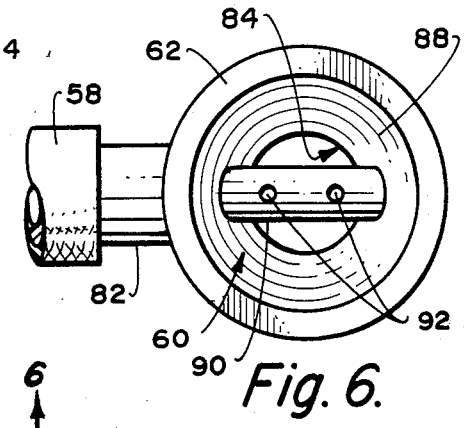
FIG. 6 is a horizontal sectional view looking along the arrows 6—6 in FIG. 5.

A second embodiment of the present invention is shown in FIGS. 5 and 6, and it merely provides an additional low pressure creating device in addition to that shown in FIGS. 1 through 4. Referring to FIGS. 5 and 6, not only is the venturi 84 installed within the casing 62, but a particular form of low pressure tube 90 is also installed. As can be seen, the low pressure tube 90 extends at right angles across the increasing angled exit portion 88 of the venturi 84 and has a pair of air exit openings 92 directed downstream intermediate the venturi 84. This, again, will add a further low pressure aiding the venturi 84 so as to positively draw the desired amount of liquid cleaner into the casing 62 for mixture with the main refill water and passage downwardly into the toilet bowl.

Figure 7:
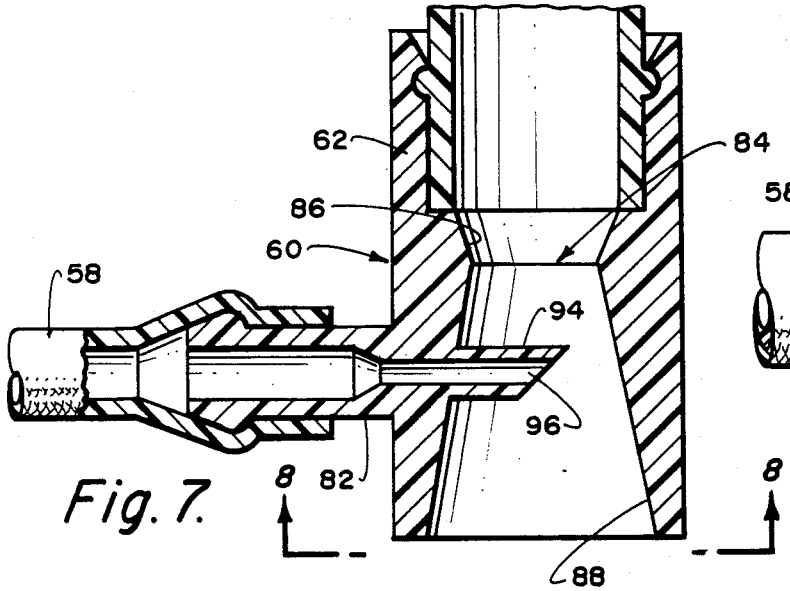
FIG. 7 is a view similar to FIG. 5, but showing a third embodiment of the cleaner discharge device of the present invention.
Figure 8:
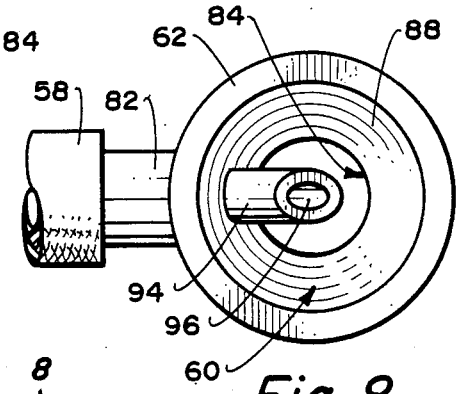
FIG. 8 is a horizontal sectional view looking along the arrows 8—8 in FIG. 7.

A somewhat similar addition is shown in the third embodiment of FIGS. 7 and 8. A low pressure tube 94 extends at right angles partially across the opening of the venturi 84 and the low pressure tube is terminated intermediate the opening in a downstream directed angle 96. With this low pressure tube 94 again at the increasing angled exit portion 88 of the venturi 84, additional low pressure is provided for insuring the proper amount of liquid cleaner for the refill water.

Figure 9:
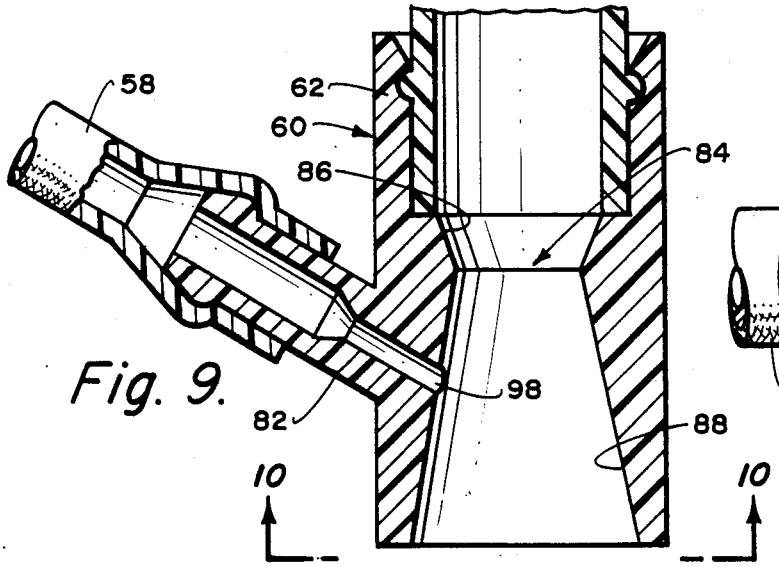
FIG. 9 is a view similar to FIGS. 5 and 7, but showing a fourth embodiment of the cleaner discharge device of the present invention.
Figure 10:
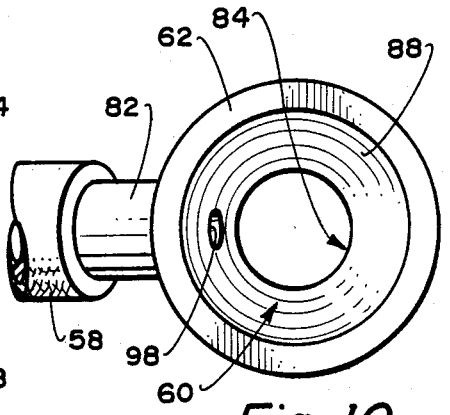
FIG. 10 is a horizontal sectional view looking along the arrows 10—10 in FIG. 9.

Finally, a fourth embodiment is shown in FIGS. 9 and 10. In this case, in addition to the venturi 84, the inlet nipple 82 is directed into the increasing angled exit portion 88 of the venturi 84 at an angle directed downstream. This angle is calculated to give increased motion to the liquid cleaner containing water received from the outlet cleaner tube 58 as it enters the venturi 84, all of this being indicated at 98.

Thus, regardless of which embodiment is used and whether or not a venturi 84 is used, not only is there a normal flushing action taking place under normal circumstances with the toilet bowl equipment, but added thereto in the refill water portion of this system, is the provision of chemical cleaner for cleaning and otherwise treating this refill water within the toilet bowl. Furthermore, it is important to note that this liquid cleaner treatment of the flushing water is directly into the toilet bowl and is not required within the much larger toilet water tank. Also, the adding of the liquid cleaner as carried out herein is totally automatic and merely based on the normal flushing of the toilet flushing equipment. For this reason, regardless of which embodiment is used, appreciable advantages are gained not otherwise possible with this form of equipment alone and without the equipment of the present invention.

As hereinbefore pointed out, applicants' use of the term "liquid cleaner" is not intended to limit the added material to cleaners alone or other materials alone, this being used as a generic term encompassing all types of cleaners, disinfectants, deodorants and the like, any one or all. Furthermore, these may be solely in liquid form when added to the container 56 or may be in solid soluble form when added and mixing with the water within the container to eventually arrive at the required liquid state. The container 56 obviously could be provided on a replacement basis, the screw top 76 thereof being removable and replaced on a replacement container.

According to the present invention, therefore, a pressure activated cleaner discharge device is provided in combination with a normal toilet flushing system. This pressure activated cleaner discharge device is of an improved form which mixes liquid cleaners or other desired added materials with the refill water within the refill water system and deposits the mixture within the refill tube so as to ultimately become deposited directly in the toilet bowl. The liquid cleaner may be inserted into the refill water solely by normal water pressure or may have, as an added safety factor, a venturi which aids the natural pressure of insertion. Still further, there may be additionally added various types of low pressure creating devices which may be used with or without the venturi, all of these being usable as desired.

Although the principles of the present invention have been herein illustrated in various particular embodiments of the pressure activated cleaner discharge device for use with toilets and the like, it is not intended to limit such principles to those constructions alone, since the same principles are readily applicable to various other forms of cleaner discharge devices. Thus, the principles of the present invention should be broadly construed and not limited beyond the specific limitations set forth in the appended claims including the patent equivilants thereof.

We claim:

1. In a pressure activated cleaner discharge device of the type for use in a toilet water tank, the water tank having a ballcock for discharging water to fill the tank from a minimum water level to a maximum water level, a flush valve connected to a toilet bowl for flushing water into the bowl from the tank, and an overflow pipe projecting above the maximum water level having a ballcock refill tube connected thereto for directing a pressure flow of tank water to fill the toilet bowl after said flushing; the cleaner discharge device in combination therewith including: a container in the tank having an inlet and an outlet, said container being at any location in said tank above or below said maximum water level; an inlet water tube connected between said refill tube and said container inlet; an outlet cleaner tube connected between said container outlet and said refill tube downstream of said inlet water tube connection; said refill tube and its connections and said container and its connections all being liquid-tight from said ballcock through said refill tube substantially throughout the downstream flow of water in said refill tube and cleaner discharge device; low pressure means operably connected between said outlet cleaner tube and said refill tube for creating positive water flow from said outlet cleaner tube into said refill tube upon flow in said refill tube permitting liquid cleaner to be placed in the container and to be forced by the pressure flow of water through said container from and to said refill tube for depositing liquid cleaner into said overflow pipe and ultimately cause it to flow into said toilet bowl.

2. In a pressure activated cleaner discharge device as defined in claim 1 in which said ballcock refill tube has an anti-syphon mechanism connected therein upstream of said inlet water tube, said anti-syphon mechanism closed under positive downstream water flow therein and providing said liquid-tight seal in said refill tube during said downstream water flow, said anti-syphon mechanism opening to the atmosphere upon a reverse upstream flow of water within said refill tube.

3. In a pressure activated cleaner discharge device as defined in Claim 1 in which said outlet cleaner tube is connected to said refill tube through an increasing angular portion of a venturi within said refill tube forming said low pressure means.

4. In a pressure activated cleaner discharge device as defined in claim 1 in which said outlet cleaner tube is connected into said refill tube through a tube extending at right angles into an interior of said refill tube and having at least one opening therein into said refill tube downstream from water flow within said refill tube, said right angle tube and said opening creating a low pressure area to form said low pressure means.

5. In a pressure activated cleaner discharge device as defined in claim 1 in which said outlet cleaner tube is connected into said refill tube by a right angle tube projecting into said refill tube and terminating in an end angled to face angularly downstream, said angled tube creating a low pressure area within said refill tube to form said low pressure means.

6. In a pressure activated cleaner discharge device as defined in claim 1 in which said outlet cleaner tube is connected into said refill tube at an angle directed downstream of said refill tube creating a low pressure area within said refill tube and forming said low pressure means.

7. In a pressure activated cleaner discharge device as defined in claim 1 in which said ballcock refill tube has anti-syphon mechanism connected therein upstream of said inlet water tube, said anti-syphon mechanism closed under positive downstream water flow therein and providing said liquid-tight seal in said refill tube during said downstream water flow, said anti-syphon mechanism opening to the atmosphere upon a reverse upstream flow of water within said refill tube; and in which said outlet cleaner tube is connected to said refill tube through an increasing angular portion of a venturi within said refill tube forming said low pressure means.

8. In a pressure activated cleaner discharge device as defined in claim 1 in which said outlet cleaner tube is connected into said refill tube through a tube extending at right angles into said refill tube and projecting into the interior of said refill tube, said projecting tube having at least one downstream opening spaced inwardly of said refill tube, said projecting tube extending internally of said refill tube from an increasing angle portion of a venturi formed within said refill tube, said projecting tube with its opening and said venturi both forming said low pressure means.

9. In a pressure activated cleaner discharge device as defined in claim 1 in which said outlet cleaner tube is connected into said refill tube by a tube extending at right angles to said refill tube and projecting into said refill tube, said projecting tube terminating within said refill tube with an angled end directed downstream, said projecting tube projecting into said refill tube at an increasing angle portion of a venturi formed within said refill tube, said projecting tube and said venturi both forming said low pressure means.

10. In a pressure activated cleaner discharge device as defined in claim 1 in which said outlet cleaner tube is connected into said refill tube at an angle directed toward said liquid downstream side, said outlet cleaner tube connection being at an increasing angle portion of a venturi formed within said refill tube, said outlet cleaner tube angling and said venturi both forming said low pressure means.

* * * * *

UNITED STATES PATENT AND TRADEMARK OFFICE

CERTIFICATE OF CORRECTION

PATENT NO. : 4,656,676

DATED : April 14, 1987

INVENTOR(S) : Oscar R. Dufau and Kabir Siddiqui

It is certified that error appears in the above-identified patent and that said Letters Patent is hereby corrected as shown below: On the Title Page add:

Adolf Schoepe , Fullerton, CA.

Signed and Sealed this

Seventeenth Day of November, 1987

*Attest:*

DONALD J. QUIGG

*Attesting Officer*

*Commissioner of Patents and Trademarks*